US006366268B1

(12) United States Patent
Forrest et al.

(10) Patent No.: US 6,366,268 B1
(45) Date of Patent: Apr. 2, 2002

(54) DISPLAY DRIVING METHOD AND DEVICE

(75) Inventors: Stephen R. Forrest, Princeton, NJ (US); Mark E. Thompson, Anaheim Hills, CA (US)

(73) Assignees: The Trustees of Princeton University, Princeton, NJ (US); The University of Southern California, Los Angeles, CA (US)

( * ) Notice: Subject to any disclaimer, the term of this patent is extended or adjusted under 35 U.S.C. 154(b) by 0 days.

(21) Appl. No.: 09/493,099

(22) Filed: Jan. 28, 2000

Related U.S. Application Data

(60) Provisional application No. 60/168,682, filed on Dec. 3, 1999.

(51) Int. Cl.[7] ..... G09G 3/32
(52) U.S. Cl. ..... 345/82; 345/83; 345/208
(58) Field of Search ..... 340/718, 783; 345/83; 324/767; 315/169.3, 506

(56) References Cited

U.S. PATENT DOCUMENTS 4,303,917 A 12/1981 Kishino et al.
4,495,445 A 1/1985 Turney
4,839,663 A 6/1989 Boudreau et al.
4,859,912 A 8/1989 Lippmann et al.
4,924,148 A 5/1990 Schwartz
5,099,178 A 3/1992 Bozzer et al.
5,237,314 A * 8/1993 Knapp ..... 340/783
5,237,315 A 8/1993 Gay et al.
5,629,716 A 5/1997 Okamoto et al.
5,751,159 A * 5/1998 Holm et al. ..... 324/767
5,812,105 A * 9/1998 Van de Ven ..... 345/83
5,818,175 A 10/1998 Yoshioka et al.
6,002,206 A * 12/1999 Harrison et al. ..... 315/506
6,008,588 A * 12/1999 Fujii ..... 315/169.3

* cited by examiner

*Primary Examiner*—Steven Saras
*Assistant Examiner*—Christopher J. Maier
(74) *Attorney, Agent, or Firm*—Kenyon & Kenyon

(57) ABSTRACT

An addressing method induces increased light output in an organic light emitting display by applying several excitation currents to each row in an display per frame. The row excitation pulses may advance sequentially across every row in the display and, when the row driver reaches the last row in the display, the row driver returns to the first row in the display and begins again. In an embodiment, the row driver may complete 100–1000 cycles across all rows in the display for each frame. This method of addressing the display yields increase light output with a correspondingly lower-powered excitation current.

16 Claims, 3 Drawing Sheets

DISPLAY DRIVING METHOD AND DEVICE

This appln claims benefit of Prov. No. 60/168,682 filed Dec. 3, 1999.

GOVERNMENT RIGHTS

This invention was made with Government support under Contract No. F33615-94-1- 1414 awarded by DARPA. The government has certain rights in this invention.

BACKGROUND OF THE INVENTION

The present invention relates to a method of driving passive matrix displays and, more particularly, to a method of driving displays based upon phosphorescent organic light emitting diode materials.

FIG. 1 is a block diagram of a conventional display addressing system 100. The addressing system 100 may be populated by a display matrix 110, a row driver 120 and a column driver 130. The display matrix may 110 include an array of picture elements ("pixels") (not shown) typically organized into a regular array of columns and rows. Each pixel row may be accessed electrically by a row line (collectively labeled 125) and each pixel column may be accessed electrically by a column line (collectively labeled 135). To activate a pixel, the pixel's row line of the pixel typically carries an electrical excitation signal; its column line typically carries data corresponding to the desired display output.

FIG. 2 is a timing diagram illustrating a conventional method of driving the display matrix 110 of FIG. 1. As is known, display information typically is organized into frames. The display data of a first frame is rendered on the display matrix, cleared, and the display data of a second frame is rendered thereafter. With conventional frame rates may span from 10–30 frames per second, a frame period may span from 30 to 100 ms.

Conventionally in modern displays, each row of a display matrix is driven with an excitation pulse having a duration of $1/N^{th}$ of a frame, where N is the number of rows in the display matrix 110. During this excitation pulse, the column driver generates data signals corresponding to the information content that should be displayed on the respective row. When the excitation pulse concludes, the row driver 120 advances to a subsequent row and applies the excitation pulse. The process repeats for every row in the display matrix. Each row receives only a single excitation pulse per frame.

Light emitting devices, when activated, typically emit light during the excitation pulse. The light output of these devices typically decays much faster than the frame period of the display. Human beings tend to perceive the output of the display as a time average of the light output over the entire frame. Thus, to achieve sufficient brightness, the light emitting devices typically are driven with very high voltages that cause the devices to emit a very strong light output to achieve a predetermined perceived brightness. Typically materials that are chosen for such displays exhibit a linearity between the excitation potential used and the light output that the material generates—if one were to double the excitation potential, the material typically generates twice the light output. This is a well-known characteristic of displays.

Recent advances in material science have developed a new class of light emitting devices based on organic materials. These "organic light emitting devices" (or, "OLEDs") may include light emitting devices whose luminescence is based on emission from long-lived phosphor dopants. OLEDs using phosphors are beneficial because they tend to be highly efficient compared to those employing more conventional fluorescent dopants. In contrast to fluorescent dopants, phosphors tend energize very quickly but decay rather slowly. OLEDs, however, are current driven rather than voltage driven devices. Phosphor-doped OLEDs do not exhibit the linearity described above with respect to other materials. The materials reach a point that they will not generate any increased light output no matter how hard the material is driven. Indeed, over-driving of the OLED displays (even in the case of fluorescent doped OLEDs) simply may damage the light emitting devices themselves and reduce the useful life of the display. The maximum light output of some of these organic materials is insufficient to generate sufficiently bright output to be useful in a display.

Notwithstanding the problems associated with the phosphor doped OLEDs, they possess remarkable other advantages for use in displays. For example, OLEDs may be stacked, a property that suggests that OLEDs can be applied in very compact display designs. Accordingly, there remains a significant commercial interest in the development of OLEDs for use in display devices.

There is a need in the art for a display driving method for OLED displays that generates higher light output further, there is a need in the art for a display driving method that drives organic light emitting devices at lower current levels and yet achieves increased brightness.

SUMMARY OF THE INVENTION

Embodiments of the present invention provide an addressing method that induces increased light output in an organic light emitting display by applying several excitation currents to each row in an display per frame. The row excitation pulses may advance sequentially across every row in the display and, when the row driver reaches the last row in the display, the row driver returns to the first row in the display and begins again. In an embodiment, the row driver may complete 10–100,000 cycles across all rows in the display for each frame. This method of addressing the display yields increase light output with a correspondingly lower-powered excitation current.

DETAILED DESCRIPTION

Embodiments of the present invention provide an addressing method that induces increased light output in an organic light emitting display. According to an embodiment, excitation currents may be applied to each row in an OLED display several times per frame. Row excitation pulses may advance sequentially across every row in the display when the row driver reaches the last row in the display, the row driver returns to the first row in the display and begins again. In an embodiment, the row driver may complete 1,000–100,000 cycles across all rows in the display for each frame.

Figure 1:
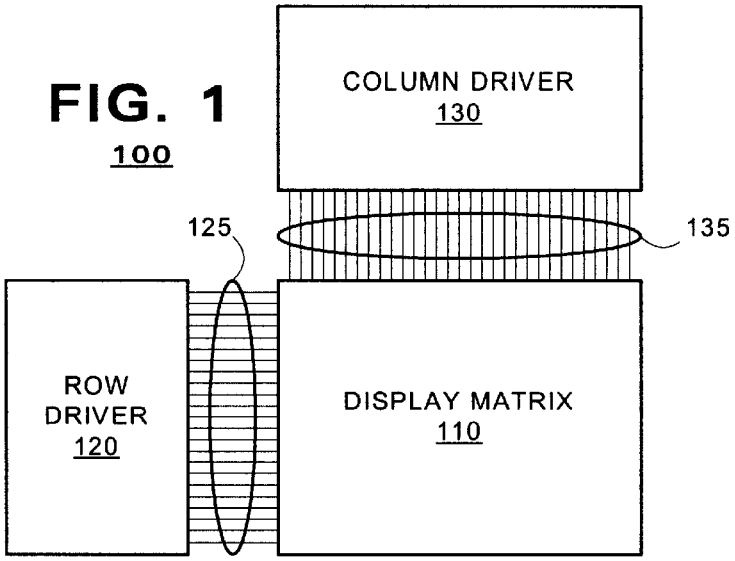
FIG. 1 illustrates a display system to which addressing methods of the present invention may be applied.
Figure 2:
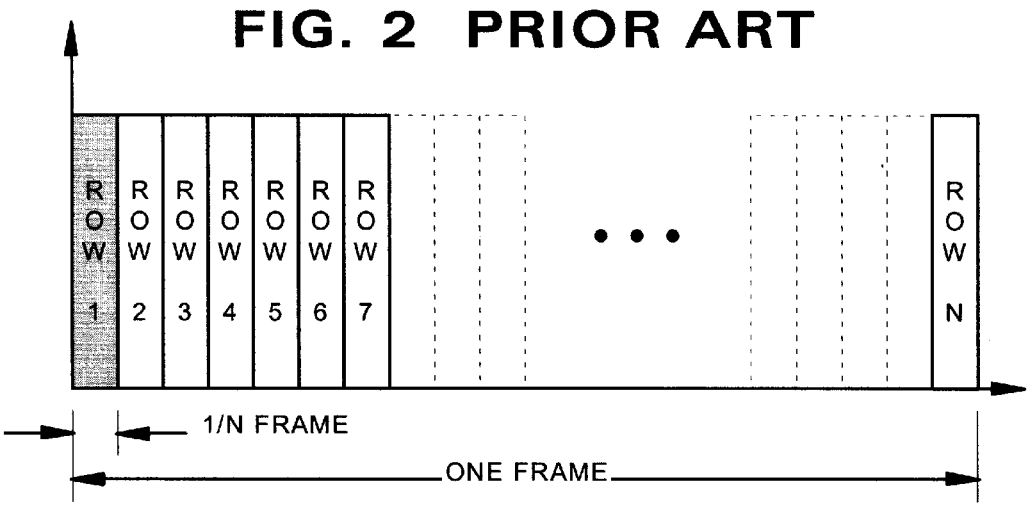
FIG. 2 PRIOR ART
FIG. 2 is a timing diagram illustrating addressing methods of the prior art.
Figure 3:
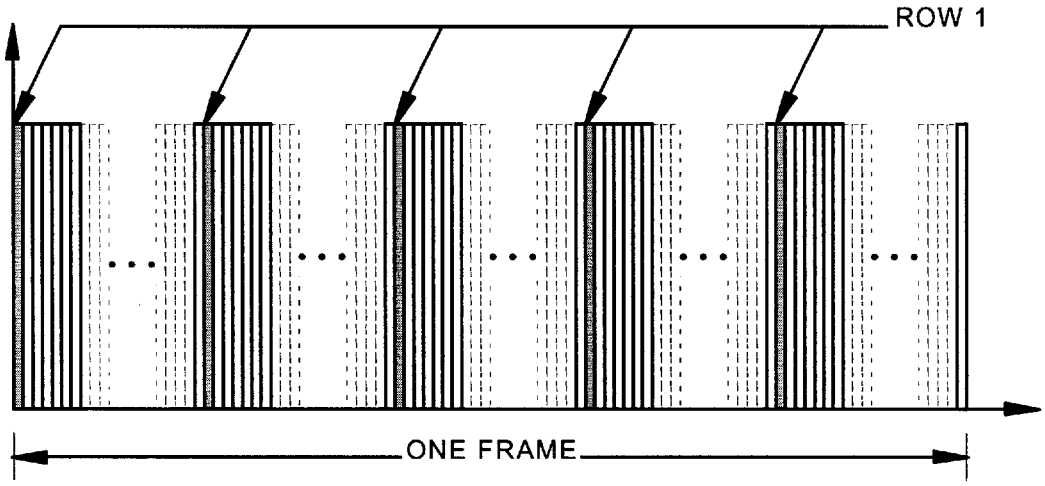
FIG. 3 is a timing diagram illustrating an addressing method according to an embodiment of the present invention.

FIG. 3 is a timing diagram illustrating operation of the present invention according to an embodiment of the present invention. FIG. 3 illustrates multiple current excitations being applied to each row in the display. The period of each frame may be thought to be sub-divided into multiple display cycles. Within each display cycle, the row driver 120 may drive excitation current onto each of the row lines 125 in sequence. Thus, each row in the display matrix 110 may be activated for $1/N^{th}$ of a cycle but X times per frame, where X represents the number of cycles in a single frame.

The timing diagram of FIG. 3 illustrates a frame divided into several cycles. The number of cycles defines a cycle period. Each row in the display matrix 110 may be excited at regular intervals corresponding to the cycle period. In an embodiment, the cycle period may be tuned to the materials that are employed in the OLED device. For example, each different OLED material may have its own decay characteristic—when excited by a predetermined excitation current, the respective row will emit light for a predetermined time, then become dark. According to an embodiment of the present invention, the number of cycles X for a given display may be tuned to ensure that the cycle period is shorter than the decay time of the materials in the display.

Figure 4A:
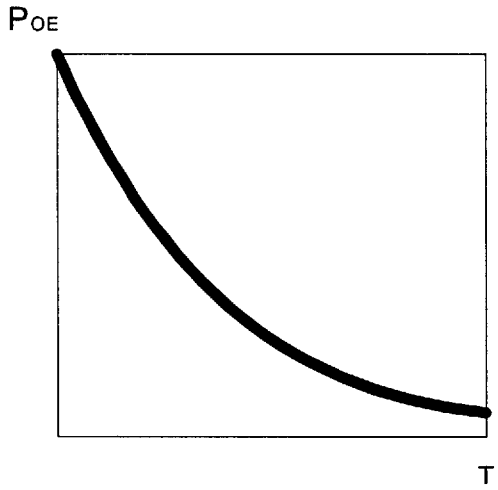
FIGS. 4(*a*)–4(*b*) are graphs illustrating differences in light output between embodiments of the present invention and those of the prior art.
Figure 4B:
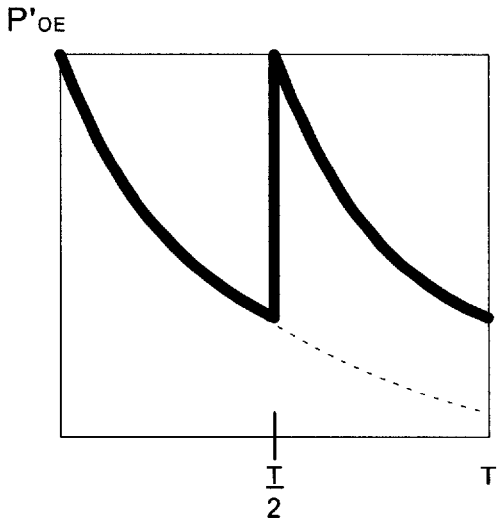

The addressing method of the present invention advantageously causes a display matrix to generate a greater amount of light output at a lower driving power level than is available in the prior art. Consider, by way of example, two identical displays. The displays may be populated by light emitting elements whose luminescence when an excitation current is instantaneously applied is characterized by an exponential decay constant $\tau$. A first display may be addressed in a manner that is conventional in the art—one excitation pulse per frame. A second display may be addressed according to the methods of the present invention—multiple excitation pulses per frame. FIGS. 4(*a*) and 4(*b*) compare the light output from an individual pixel in each display.

In FIG. 4(*a*), the pixels are driven by excitation current to achieve a peak power $P_{OE}$. The excitation pulse causes the pixels to emit light at the excitation power level. When the excitation pulse is removed, the light output decays according the delay constant $\tau$. The average power of the light output over a frame time, T, in the example of FIG. 4(*a*) may be given by:

$$\langle p\rangle = \frac{1}{T}\int_0^T P_{OE}e^{-t/\tau}dt = -\frac{P_{OE}}{T}(e^{-T/\tau}-1)$$

FIG. 4(*b*) illustrates an example where there are only two excitation pulses per frame. The pixels are driven by excitation current to achieve a peak power level $P'_{OE}$. In this example, each excitation pulse causes the pixels to emit light at the excitation power level. When the excitation pulses are removed, the light output decays according the delay constant $\tau$. The average power of the light output in the example of FIG. 4(*a*) may be given by:

$$\langle p\rangle' = P'_{OE}\left[\frac{1}{T}\int_0^T e^{-t/\tau}dt + \frac{2}{T}\int_{T/2}^T e^{-t/z}dt\right] = \frac{P'_{OE}\tau}{T}[1-3e^{-T/\tau}+2e^{-t/2\tau}]$$

One may determine the relative efficiencies of the two addressing schemes by setting <p> to be equal to<p>' and determining the relationship between $P_{OE}$ to $P'_{OE}$. By establishing this equality:

$$\frac{P_{OE}}{P'_{OE}} = \frac{(1-3e^{-T/\tau}+2e^{-T/2\tau}}{1-e^{-T/\tau}}$$

and, for those materials where $T>\tau>T/2$:

$$\frac{P_{OE}}{P'_{OE}} \approx \frac{(1+2e^{-T/2\tau})}{1-e^{-T/\tau}} > 1$$

This relation demonstrates that $P_{OE}>P'_{OE}$. Or, stated alternatively, the same average output power may be achieved by exciting pixel elements with a lower powered excitation pulse with more pulses per frame.

The address scheme described above may be applied advantageously to organic, phosphorescent materials. The phosphorescent materials are beneficial because they are fast to activate and slow to decay. By way of example, the following materials may be used in displays and addressed according to the techniques described here.

Figure 5:
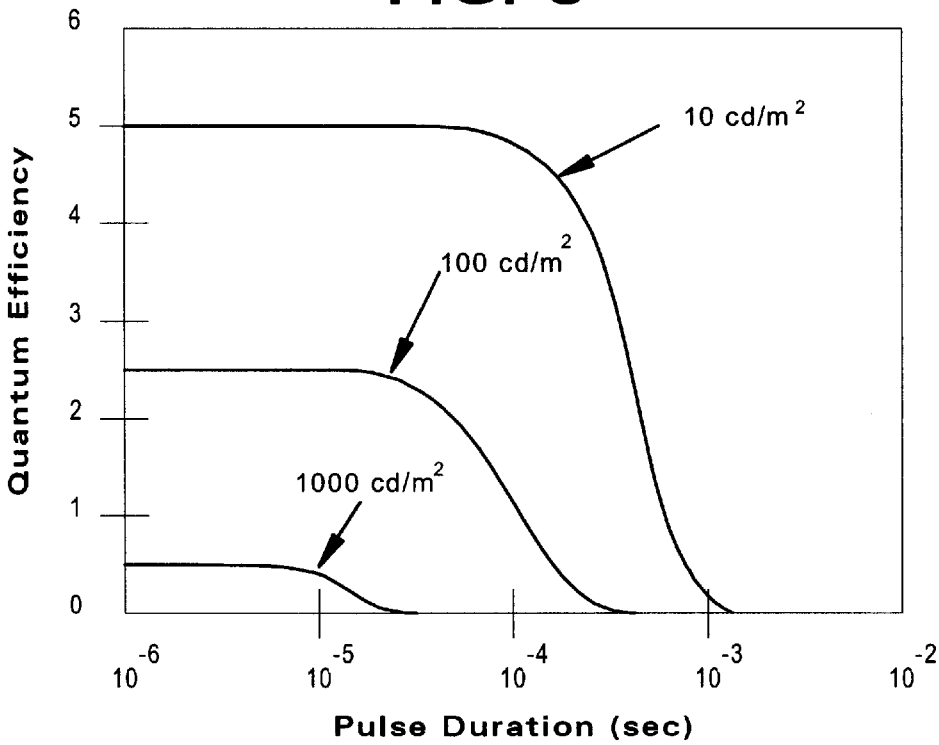
FIG. 5 is a graph illustrating calculated light output for various embodiments of the present invention with respect to a particular embodiment of display.

FIG. 5 provides a graph illustrating calculated light output from a display device having the well-known phosphorescent doped active layer consisting of PtOEP:CPB in a light emitting pixel ($\tau$=70 $\mu$s). At $10^4$ pulses per second, it is possible to obtain 10 cd/m2 output from the display at an external quantum efficiency of 5%. At $10^5$ pulses per second, the display should achieve a 100 cd/m$^2$ output at an external quantum efficiency of 2.5%. And at $5\times10^5$ (or $10^6$) pulses per second, the display may be able to achieve 1000 cd/m$^2$ at an external quantum efficiency of 0.5%. At lower pulse repetition rates, the quantum efficiency of phosphorescence falls rapidly to zero, at which point the display is no longer useful. In an exemplary 100-row display, a row driver would incrementally advance from row to row at approximately a 3 MHz rate. This is an achievable display rate for modern computer systems.

Figure 6:
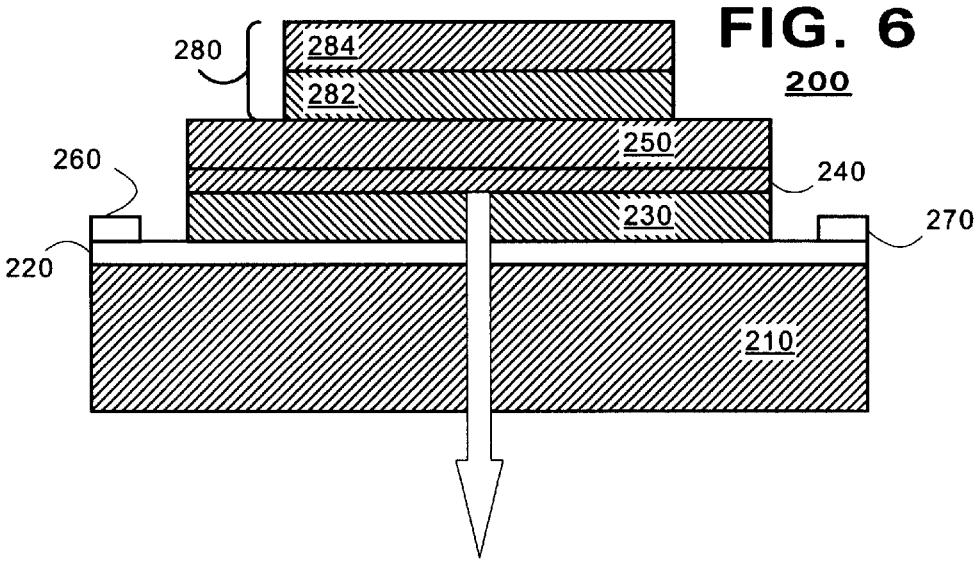
FIG. 6 is a diagram of a pixel suitable for use with the present invention.

As noted, the preceding graph relates to calculated light output that may be obtained from a display device populated by pixels of PtOEP:CPB. An exemplary pixel is shown in FIG. 6 having a substrate layer of glass 210 coated by a thin layer of indium-tin-oxide (ITO) serving as an anode 220. A thin (100–500 Å) organic hole transporting layer (HTL) 230 may be deposited on the anode layer 220. An emission layer 240 may be deposited on the surface of the HTL 230. This emission layer may include the PtOEP:CPB described above with respect to FIG. 5. An electron transport layer 250 may be provided upon the emission layer 240. The emission layer 240 typically provides the site for electrons injected from the electron transporting layer (ETL) 250 to recombine with holes from the HTL 230. In an embodiment, the HTL 230 may include $\alpha$-NPD and the ETL 250 may include Alq.

The exemplary pixel of FIG. 6 may further include metal contacts 260 and/or 270 and and a top electrode 280. Contacts 260, 270 may be indium or Ti/Pt/Au. Electrode 280 may be a dual layer structure consisting of an alloy layer 282 (such as Mg/Ag) provided in direct contacting with the ETL 250, and a thicker second layer 284 having high work function metal layer. This second layer may be as gold (Au)

or silver (Ag) provided on the Mg/Ag. When proper bias voltage is applied between top electrode 280 and contacts 260, 270, light emission occurs from emissive layer 240 through the glass substrate 210.

The addressing scheme of the present invention can be used to provide a flat panel display having a higher brightness than is conventionally known. The display may be provided in any size, including displays as small as a few millimeters to as large as the size of a building, for almost any application. The images created on the display could be text or illustrations in full color, in any resolution depending on the size of the individual LED's. Display devices of the present invention are therefore appropriate for an extremely wide variety of applications including billboards and signs, computer monitors, displays for portable appliances such as cellphones, laptops, personal digital assistants and vehicular displays, telecommunications devices such as telephones, televisions, large area wall screens, theater screens and stadium screens.

Several embodiments of the present invention are specifically illustrated and described herein. However, it will be appreciated that modifications and variations of the present invention are covered by the above teachings and within the purview of the appended claims without departing from the spirit and intended scope of the invention.

We claim:

1. An addressing display method that generates excitation signals for display matrix rows in order by row, each row being made subject to the excitation signal at least twice during a period of time defined by a decay characteristic of a light emitting material of the row.

2. A method of addressing a display, comprising:

generating an excitation signal on each row of the display in succession, for each row, driving data on pixels of the row while the row is subject to the excitation signal, and wherein each row is made subject to the excitation signal at least twice during a period of time defined by a decay characteristic of a light emitting material of the row.

3. The method of claim 2, wherein the excitation signal is an excitation current in the display.

4. The method of claim 2, wherein the display is populated by a plurality of organic light emitting display elements.

5. The method of claim 4, wherein the OLED elements include a phosphorescent doped active layer.

6. The method of claim 2, wherein there are at least 1,000 excitation pulses per row per second.

7. The method of claim 2, wherein there are at least 10,000 excitation pulses per row per second.

8. The method of claim 2, wherein there are at least 100,000 excitation pulses per row per second.

9. A display, comprising:

a display matrix populated by a plurality of pixels organized into a regular array of row and columns, a row driver that generates an excitation signal successively on each row of the display matrix, a column driver that drives data on the pixels of the display matrix, wherein the row driver subjects each row to the excitation signal at least twice during a period of time defined by a decay characteristic of a light emitting material of the row.

10. The display of claim 9, wherein the row driver generates an excitation current.

11. The display of claim 9, wherein the pixels are organic light emitting display elements.

12. The display of claim 11, wherein the OLED elements include a phosphorescent doped active layer.

13. The display of claim 9, wherein there are at least 1,000 excitation pulses per row per second.

14. The display of claim 9, wherein there are at least 10,000 excitation pulses per row per second.

15. The display of claim 9, wherein there are at least 100,000 excitation pulses per row per second.

16. The display of claim 9, wherein the display is one of a member of: an electronic billboard, a computer monitor, a cellphone display, a laptop display, a personal digital assistant display, a vehicular display, a telephone display, a television, a wall screen, a theater screen and a stadium screen.

* * * * *

UNITED STATES PATENT AND TRADEMARK OFFICE

CERTIFICATE OF CORRECTION

PATENT NO. : 6,366,268 B1
DATED : April 2, 2002
INVENTOR(S) : Forrest et al.

It is certified that error appears in the above-identified patent and that said Letters Patent is hereby corrected as shown below:

Column 2,
Line 26, after “light” change “output further,” to -- output. Further, --; and Column 4,
Line 6, change “to<p>’” to -- to <p>’ --.

Signed and Sealed this

Fourteenth Day of January, 2003

JAMES E. ROGAN
*Director of the United States Patent and Trademark Office*